US006164412A

United States Patent [19]

Allman

[11] Patent Number: 6,164,412

[45] Date of Patent: Dec. 26, 2000

[54] MUFFLER

[75] Inventor: James R. Allman, North Vernon, Ind.

[73] Assignee: Arvin Industries, Inc., Columbus, Ind.

[21] Appl. No.: 09/285,546

[22] Filed: Apr. 2, 1999

Related U.S. Application Data

[60] Provisional application No. 60/080,578, Apr. 3, 1998.

[51] Int. Cl.[7] ..... F01N 1/08

[52] U.S. Cl. ..... 181/272; 181/282

[58] Field of Search ..... 181/264, 265, 181/266, 269, 272, 282

[56] References Cited

U.S. PATENT DOCUMENTS

| | | |
|---|---|---|
| 2,274,460 | 2/1942 | Rauen . |
| 3,125,182 | 3/1964 | Earley . |
| 3,209,859 | 10/1965 | Lentz et al. . |
| 3,638,756 | 2/1972 | Thiele . |
| 3,827,529 | 8/1974 | Frietzsche et al. . |
| 4,164,266 | 8/1979 | Collin et al. . |
| 4,185,715 | 1/1980 | Reu Boiu . |
| 4,456,091 | 6/1984 | Blanchot . |
| 4,637,491 | 1/1987 | Fukuda . |
| 4,744,233 | 5/1988 | Trudell . |
| 4,860,853 | 8/1989 | Moring, III . |
| 4,901,816 | 2/1990 | Garey . |
| 4,909,348 | 3/1990 | Harwood et al. . |
| 4,928,372 | 5/1990 | Harwood et al. . |
| 4,941,545 | 7/1990 | Wilcox et al. . |
| 4,953,660 | 9/1990 | Jewell, Jr. et al. . |
| 5,147,987 | 9/1992 | Richardson et al. . |
| 5,187,334 | 2/1993 | Abbott et al. . |
| 5,198,625 | 3/1993 | Borla ..... 181/282 |
| 5,216,809 | 6/1993 | Abbott et al. . |
| 5,229,557 | 7/1993 | Allman et al. . |
| 5,252,788 | 10/1993 | Emrick et al. . |
| 5,563,385 | 10/1996 | Harwood . |
| 5,597,986 | 1/1997 | Harwood et al. . |
| 5,717,173 | 2/1998 | Gerber et al. . |
| 5,816,361 | 10/1998 | Gerber . |
| 5,907,904 | 6/1999 | Gerber et al. . |

*Primary Examiner*—Khanh Dang
*Attorney, Agent, or Firm*—Barnes & Thornburg

[57] ABSTRACT

A muffler includes an outer shell defining a chamber and first and second tubes positioned in the chamber. The first tube has a flat side wall and the second tube has a flat side wall positioned adjacent to the fiat side wall of the first tube. Muffler further includes a baffle plate including a base and an edge defining a tube-receiving aperture and the first and second tube are positioned in the tube-receiving aperture.

45 Claims, 4 Drawing Sheets

MUFFLER

This application claims priority under U.S.C. § 119 (e) to U.S. Provisional Application No. 60/080,578, filed Apr. 3, 1998, which is expressly incorporated by reference herein.

BACKGROUND AND SUMMARY OF THE INVENTION

This invention relates to exhaust systems and, in particular, to mufflers for quieting the exhaust noise of vehicle engines. More particularly, this invention relates to mufflers having outer shells and a plurality of tubes situated between the outer shells.

Mufflers include a plurality of chambers and tubes positioned between the stamped outer shells. The chambers and tubes direct exhaust gas of the vehicle engine through the muffler in a desired manner to quiet the exhaust noise produced by the vehicle engine effectively.

According to the present invention, a muffler is provided having an outer shell defining a chamber and first and second tubes positioned in the chamber. The first tube has a flat side wall and the second tube has a flat side wall positioned adjacent to the flat side wall of the first tube.

According to a preferred embodiment of the present invention, the first tube includes spaced-apart first and second ends. The side wall of the first tube defines a first passage and includes an edge positioned between the first and second ends that defines a first aperture. The second tube includes spaced-apart first and second ends. The side wall of the second tube defines a second passage and includes an edge positioned between the first and second ends that defines a second aperture. The wall of the first tube contacts the wall of the second tube so that the first aperture of the first tube communicates with the second aperture of the second tube. The second tube further includes a conduit coupled to the side wall that extends from the edge of the second tube to the first aperture of the first tube so that the passage defined by the edge permits communication between the first passage of the first tube and the second passage of the second tube.

In preferred embodiments, the muffler further includes a baffle plate positioned in the chamber defined by the outer shell. The baffle includes base and an edge defining a tube-receiving aperture and the first and second tubes are positioned in the tube-receiving aperture.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 2:
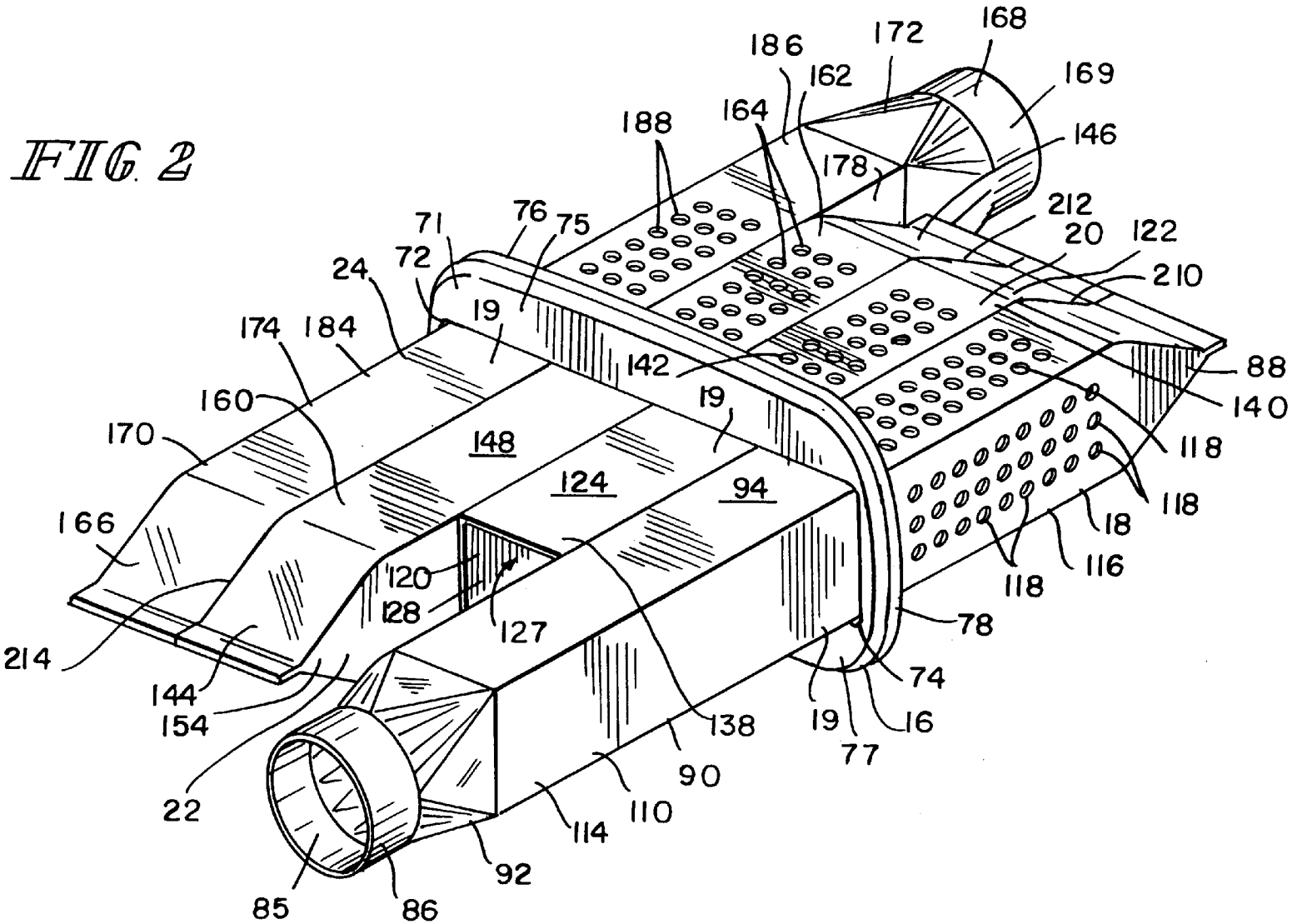
FIG. 2 is a perspective view of the four square-shaped tubes positioned together in side-by-side relation and arranged to extend through a rectangle-shaped tube-receiving aperture formed in the baffle plate.
Figure 3:
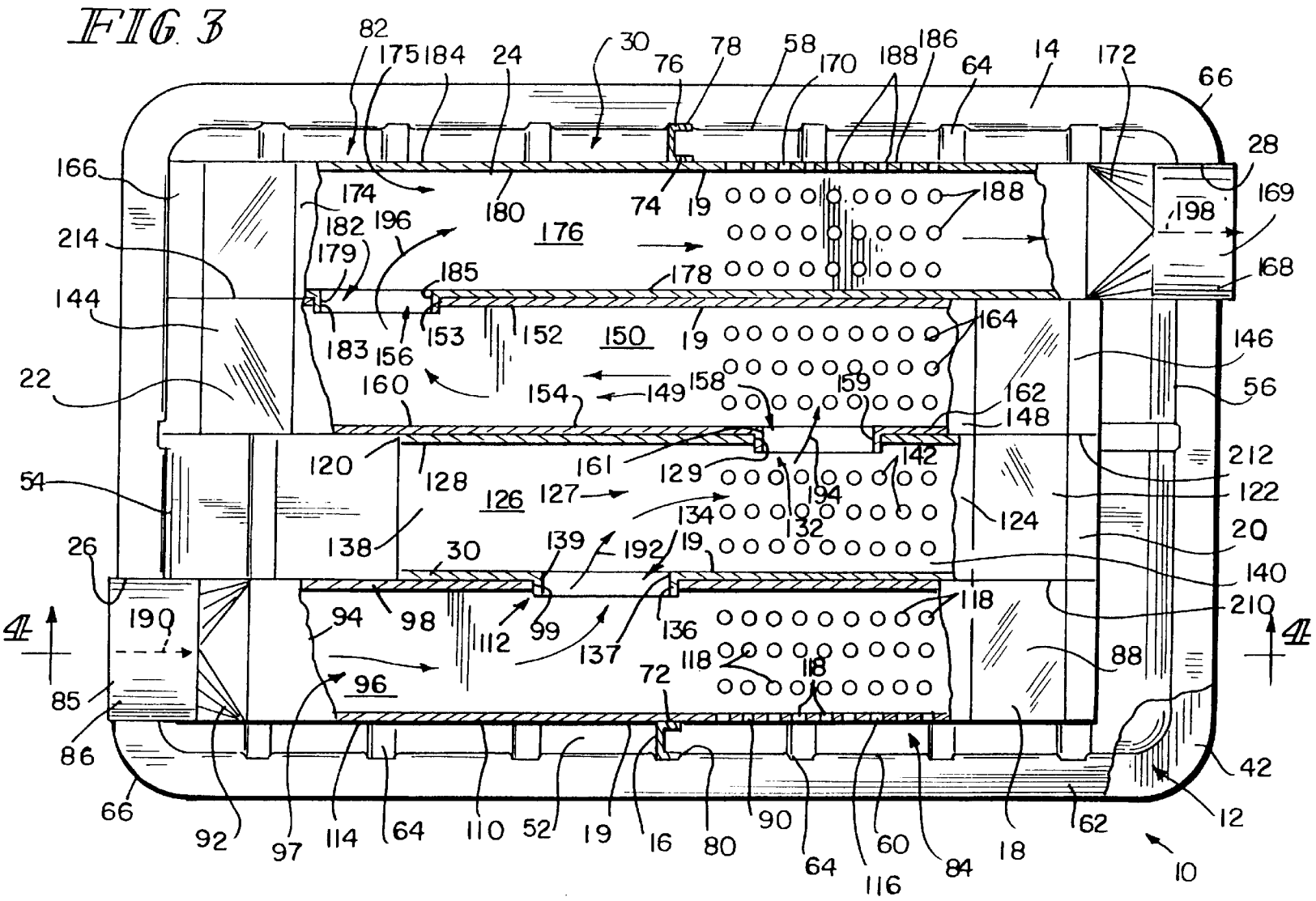
FIG. 3 is a top plan view, with portions broken away, of the muffler showing the square-shaped tubes and baffle plate shown in FIG. 1 lying in the bottom outer shell and the flow of exhaust gas along a serpentine path from a muffler inlet to a muffler outlet.
Figure 4:
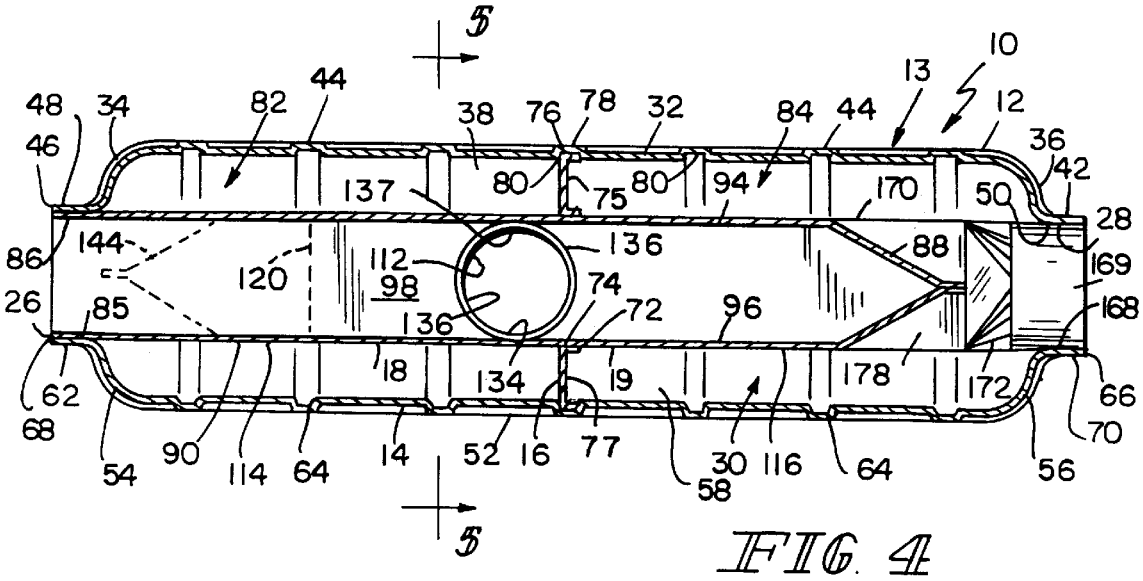
FIG. 4 is a sectional view taken along line 4—4 of FIG. 5 showing the square-shaped tubes having opened ends and closed ends and being formed to include apertures to permit exhaust gas to travel between the square-shaped tubes.
Figure 5:
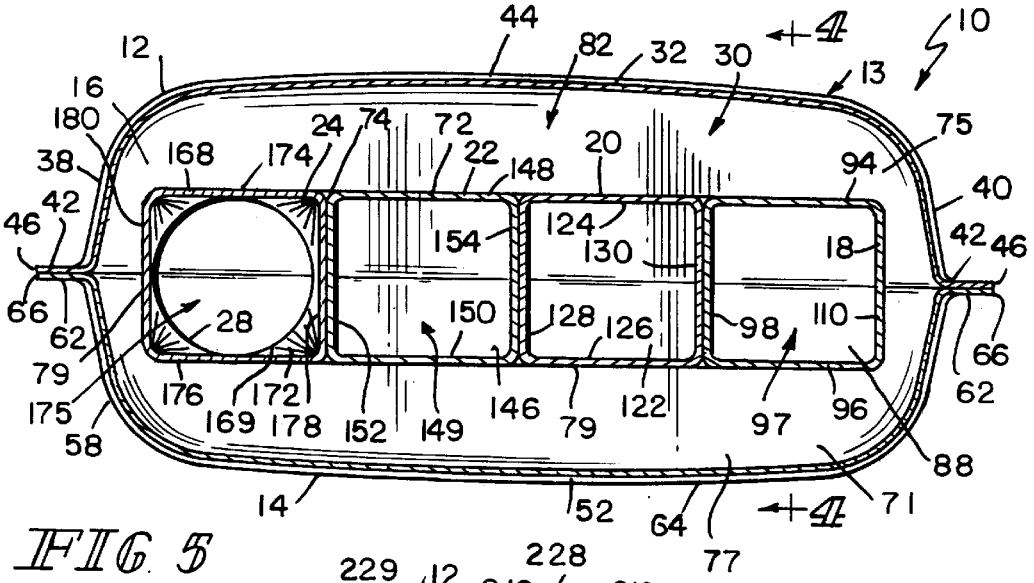
FIG. 5 is a sectional view taken along line 5—5 of FIG. 4, showing the four square-shaped tubes and baffle plate situated between the top and bottom outer shells.

A muffler 10 including a stamped top outer shell 12, a stamped bottom outer shell 14, a vertically-extending baffle plate 16, and first, second, third, and fourth horizontally-extending tubes 18, 20, 22, 24 formed to include central body portions 19 having square-shaped cross sections (hereinafter "square-shaped tubes" 18, 20, 22, 24), is shown in FIGS. 1–5. Baffle plate 16 and square-shaped tubes 18, 20, 22, 24 are positioned to lie in a tube-receiving chamber 30 formed between top and bottom outer shells 12, 14 as shown in FIGS. 4 and 5. Square-shaped tubes 18, 20, 22, 24 have substantially flat surfaces that are easy to weld or otherwise couple.

Exhaust gas enters muffler 10 through a muffler inlet 26 and passes through square-shaped tubes 18, 20, 22, 24 to a muffler outlet 28 where the exhaust gas exits muffler 10. By forming apertures in side walls of tubes 18, 20, 22, 24 and placing one tube in side-by-side relation with a tube having a corresponding aperture so that the two apertures align to define an exhaust gas flow passageway as shown best in FIG. 3, muffler 10 can be constructed so that exhaust gas flows along a serpentine path inside muffler 10 from one tube to an adjacent tube as the exhaust gas moves through muffler 10 from inlet 26 toward outlet 28.

It is within the scope of this invention to use one or more square-shaped tubes 18, 20, 22, 24 in muffler 10 and also mount two or more square-shaped tubes 18, 20, 22, 24 or tubes having a flat side walls in side-by-side relation in muffler chamber 30. In a currently preferred embodiment, muffler chamber 30 is sized to receive four square-shaped tubes 18, 20, 22, 24 arranged to lie in side-by-side relation as shown, for example, in FIGS. 2–5.

Figure 1:
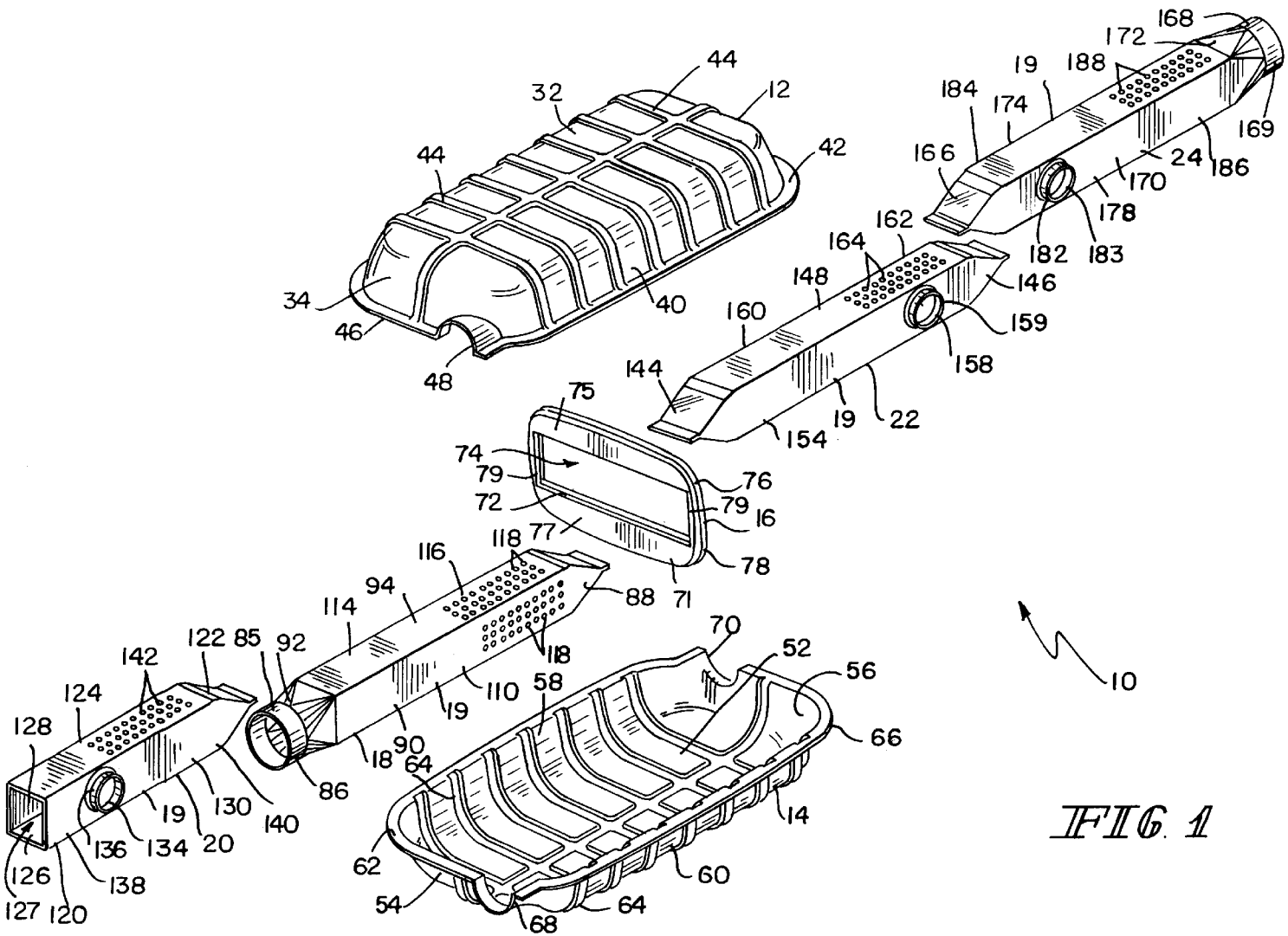
FIG. 1 is an exploded perspective view of a muffler according to the present invention showing the muffler including a stamped top outer shell, a stamped bottom outer shell, a vertical baffle plate, and four square-shaped tubes.

Top outer shell 12 is formed to include various functional contours and edges. Top outer shell 12 includes a top wall 32, first and second end walls 34, 36, first and second side walls 38, 40 extending between first and second end walls 34, 36, and a flange 42 appended to side walls 38, 40 and end walls 34, 36 as shown in FIGS. 1, 4, and 5. First and second end walls 34, 36 and first and second side walls 38, 40 are appended to top wall 32 and extend from top wall 32 to flange 44 at a perimeter edge 46 as shown in FIGS. 1, 4, and 5. Top wall 32, first and second end walls 34, 36, and first and second side walls 38, 40 are formed to include stiffening ribs 44. Stiffening ribs 44 raise the resonant frequency of the top outer shell 12 which reduces the vibration of and noise created by top outer shell 12. First end wall 34 is formed to include an inlet passageway 48 and second end wall 36 is formed to include an outlet passageway 50 as shown in FIGS. 1 and 4. All components of muffler 10 are stamped from a sheets of stainless steel. In alternative embodiments, the components may be stamped from sheets of cold-rolled, stainless steel, aluminized stainless steel, and any other appropriate type of material.

Similar to top outer shell 12, bottom outer shell 14 is also formed to include various functional contours and edges. Bottom outer shell 14 includes a bottom wall 52, first and second end walls 54, 56, and first and second side walls 58, 60 extending between first and second end walls 54, 56, and a perimeter flange 62 appended to end walls 54, 56, and side walls 58, 60. First and second end walls 54, 56 and first and second side walls 58, 60 are appended to bottom wall 52 and extend from bottom wall 52 to flange 62 at a perimeter edge 66 as shown in FIGS. 1, 4, and 5. Bottom wall 52, first and second end walls 54, 56, and first and second side walls 58, 60 are formed to include stiffening ribs 64. Stiffening ribs 64 raise the resonant frequency of the bottom outer shell 14 which reduces the vibration of and noise created by bottom outer shell 14. First end wall 54 is formed to include an inlet passageway 68 and second end wall 56 is formed to include an outlet passageway 70 as shown in FIGS. 1 and 4.

Top and bottom outer shells 12, 14 cooperate to define an outer shell 13 defining tube-receiving chamber 30 therein. Top and bottom outer shells 12, 14 cooperate to accept baffle plate 16 and square-shaped tubes 18, 20, 22, 24 and mate along perimeter edges 46, 66 to secure baffle plate 16 and square-shaped tubes 18, 20, 22, 24 between top and bottom outer shells 12, 14 as shown, for example, in FIGS. 4 and 5. Perimeter edges 46, 66 are then welded or otherwise mechanically locked together to form muffler 10. Other configurations of outer shells known to those of ordinary skill in the art may also be used with baffle plate 16 and square-shaped tubes 18, 20, 22, 24.

Baffle plate 16 is formed to secure square-shaped tubes 18, 20, 22, 24 within top and bottom outer shells 12, 14 and divide tube-receiving chamber 30 into first and second subchambers 82, 84 as shown, for example, in FIG. 4. Baffle plate 16 includes a base 71, an inner flange 72 coupled to base 71 and having a continuous inner edge 73 with flat portions 79 that define a rectangle-shaped tube-receiving aperture 74, and an outer flange 76 coupled to base 71 and having a perimeter edge 78 as shown in FIGS. 1–5. Baffle plate 16 includes a first portion 75 positioned between top outer shell 12 and square-shaped tubes 18, 20, 22, 24 and a second portion 77 positioned between bottom outer shell 14 and square-shaped tubes 18, 20, 22, 24. First and second portions 75, 77 of baffle plate 16 cooperate to define tube-receiving aperture 74 and are integral with each other.

Square-shaped tubes 18, 20, 22, 24 extend through rectangle-shaped tube-receiving aperture 74 as shown, for example, in FIGS. 2 and 5. Square-shaped tubes 18, 20, 22, 24 are secured within baffle plate 16 by a press-fit with inner flange 72 of baffle plate 16. Outer flange 76 engages top and bottom outer shells 12, 14 as shown in FIGS. 3–5. More specifically, outer flange 76 is situated in a groove 80 formed by stiffening ribs 44, 64 of top and bottom outer shells 12, 14 as shown, for example, in FIGS. 3 and 4. In alternative embodiments, the outer flange of the baffle plate is positioned adjacent to top and bottom outer shells, but is not nested in grooves so that baffle plate free-floats between the top and bottom outer shells. In other embodiments, the outer flange of the baffle plate may be welded or otherwise coupled to the top and bottom outer shells.

First square-shaped tube 18 is formed to communicate exhaust gas from an exhaust system (not shown) into muffler 10. First square-shaped tube 18 includes an opened inlet end 86, a closed end 88 spaced apart from inlet end 86, and a square-shaped body portion 90 extending between inlet and closed ends 86, 88 as shown in FIGS. 1–5. Inlet end 86 includes a round inlet tube portion 85 having a circular cross-section and is positioned to lie in inlet passageways 48, 68 formed in top and bottom outer shells 12, 14 so that exhaust gas enters muffler 10 through inlet end 86. First square-shaped tube 18 also includes a transition portion 92 extending between circular inlet end 86 and square-shaped body portion 90.

First square-shaped tube 18 further includes a top side wall 94 facing toward top wall 32, a bottom side wall 96 facing toward bottom wall 52, a first vertical side wall 98 extending between top side wall 94 and bottom side wall 96 and facing toward second square-shaped tube 20, and a second vertical side wall 110 extending between top side wall 94 and bottom side wall 96 and facing away from second square-shaped tube 20 as shown, for example, in FIG. 3. Each side wall 94, 96, 98, 1 10 is substantially flat creating the square-shape of first square-shaped tube 18 and cooperates with the other side walls 96, 98, 110, 94 to define a first tube passage 97 therebetween having a square cross-section.

First vertical side wall 98 of first square-shaped tube 18 includes an edge 99 positioned between inlet end 86 and closed end 88 and defining an exhaust gas-discharging aperture 112 as shown in FIG. 3. First square-shaped tube 18 further includes a first section 114 positioned to lie in first subchamber 82 and a second section 116 positioned to lie in second subchamber 84. Second section 116 is formed to include a plurality of perforations 118 so that exhaust gas flowing through first square-shaped tube 18 communicates with second subchamber 84. Perforations 118 are formed in top side wall 94, bottom side wall 96, and second vertical side wall 110 in second section 116 of first square-shaped tube 18 as shown, for example, in FIGS. 1–3.

Second square-shaped tube 20 is positioned to contact and communicate with first and third square-shaped tubes 18, 22 and first and second subchambers 82, 84. Second square-shaped tube 20 includes a square-shaped opened end 120 and a closed end 122 spaced apart from square-shaped opened end 120 as shown, for example, in FIGS. 1–3. Square-shaped opened end 120 is situated in first subchamber 82 so that exhaust gas flowing through second square-shaped tube 20 communicates with first subchamber 82.

Second square-shaped tube 20 further includes a top side wall 124 facing toward top wall 32, a bottom side wall 126 facing toward bottom wall 52, a first vertical side wall 128 extending between top side wall 124 and bottom side wall 126 and facing toward third square-shaped tube 22, and a second vertical side wall 130 extending between top side wall 124 and bottom side wall 126 and facing toward first square-shaped tube 18 as shown, for example, in FIG. 3. Each side wall 124, 126, 128, 130 is substantially flat creating the square-shape of second square-shaped tube 20 and cooperates with the other side walls 126, 128, 130, 124 to define a second tube passage 127 therebetween having a square cross-section. In preferred embodiments of the present invention, first vertical side wall 98 of first square-shaped tube 18 is coupled to second vertical side wall 130 of second square-shaped tube 20 by MIG tack-welding first square-shaped tube 18 to second square-shaped tube 20 at locations 210 on both the top and bottom side walls 94, 96, 124, 126 of first and second square-shaped tubes 18, 20 as shown, for example, in FIG. 2.

First vertical side wall 128 of second square-shaped tube 20 includes an edge 129 positioned between opened end 120 and closed end 122 and defining an exhaust gas-discharging aperture 132 as shown in FIG. 3. Second square-shaped tube 20 further includes a circular-shaped flange or conduit 136 positioned between opened end 120 and closed end 122 that includes an edge 139 that defines an exhaust gas-admitting aperture 134. Circular flange 136 extends into exhaust gas-discharging aperture 112 formed in first square-shaped tube 18 to form a first exhaust gas passage 137 so that exhaust gas can travel from first tube passage 97 defined by first square-shaped tube 18 through first exhaust gas passage 137 into second tube passage 127 defined by second square-shaped tube 20 as shown in FIG. 3.

Second square-shaped tube 20 further includes a first section 138 positioned to lie in first subchamber 82 and a second section 140 positioned to lie in second subchamber 84. Second section 140 is formed to include a plurality of perforations 142 so that exhaust gas passing through second square-shaped tube 20 communicates with second subchamber 84. Perforations 142 are formed in top side wall 124 and bottom side wall 126 in second section 140 of second square-shaped tube 20 as shown, for example, in FIGS. 1–3. First subchamber 82 is a Helmholtz tuning chamber for attenuating low frequency sound waves and first section 138 of second square-shaped tube 20 extends into first subchamber 82 as a tuning throat.

Third square-shaped tube 22 is positioned to contact and communicate with second and fourth square-shaped tubes 20, 24 and lie within first and second subchambers 82, 84. Third square-shaped tube 22 includes a first closed end 144, a second closed end 146 spaced apart from first closed end 144, a top side wall 148 facing toward top wall 32, a bottom side wall 150 facing toward bottom wall 52, a first vertical side wall 152 extending between top side wall 148 and bottom side wall 150 and facing toward fourth square-shaped tube 24, and a second vertical side wall 154 extending between top side wall 148 and bottom side wall 150 and facing toward second square-shaped tube 20 as shown, for example, in FIGS. 1, 2, and 5. Each side wall 148, 150, 152, 154 is substantially flat creating the square-shape of third square-shaped tube 22 and cooperates with the other side walls 150, 152, 154, 148 to define a third tube passage 149 therebetween having a square cross-section. In preferred embodiments of the present invention, first vertical side wall 128 of second square-shaped tube 20 is coupled to second vertical side wall 154 of third square-shaped tube 22 by MIG tack-welding second square-shaped tube 20 to third square-shaped tube 22 at locations 212 on both the top and bottom side walls 124, 126, 148, 150 of second and third square-shaped tubes 20, 22 as shown, for example, in FIG. 2.

First vertical side wall 152 of third square-shaped tube 22 includes an edge 153 positioned between first closed end 144 and second closed end 146 and defining an exhaust gas-discharging aperture 156 as shown in FIG. 3. Third square-shaped tube 22 further includes a circular-shaped flange or conduit 159 positioned between first closed end 144 and second closed end 146 that includes an edge 155 that defines an exhaust gas-admitting aperture 158. Circular-shaped flange 159 extends into exhaust gas-discharging aperture 132 formed in second square-shaped tube 20 to form a second exhaust gas passage 161 so that exhaust gas can travel from second passage 127 defined by second square-shaped tube 20 through second exhaust gas passage 161 into third tube passage 149 defined by third square-shaped tube 22 as shown in FIG. 3.

Third square-shaped tube 22 further includes a first section 160 positioned to lie in first subchamber 82 and a second section 162 positioned to lie in second subchamber 84. Second section 162 is formed to include a plurality of perforations 164 so that exhaust gas passing through third square-shaped tube 22 communicates with second subchamber 84. Perforations 164 are formed in top side wall 148 and bottom side wall 150 of second section 162 of third square-shaped tube 22 as shown, for example, in FIGS. 1–3.

Fourth square-shaped tube 24 is positioned to contact and communicate with third square-shaped tube 22 and the remainder of the exhaust system (not shown) positioned to lie downstream of muffler 10. Fourth square-shaped tube 24 includes a closed end 166, an opened outlet end 168 spaced apart from closed end 166, and a square-shaped body portion 170 extending between closed and outlet ends 166, 168 as shown in FIGS. 1–5. Outlet end 168 includes a round outlet tube portion 169 having a circular cross-section and is positioned to lie in outlet passageways 50, 70 of top and bottom outer shells 12, 14 so that exhaust gas exits muffler 10 through outlet end 168. Fourth square-shaped tube 24 also includes a transition portion 172 extending between circular outlet end 168 and square-shaped body portion 170.

Fourth square-shaped tube 24 further includes a top side wall 174 facing toward top wall 32, a bottom side wall 176 facing toward bottom wall 52, a first vertical side wall 178 extending between top side wall 174 and bottom side wall 176 and facing toward third square-shaped tube 22, and a second vertical side wall 180 extending between top side wall 174 and bottom side wall 176 and facing away from third square-shaped tube 22 as shown, for example, in FIG. 5. Each side wall 174, 176, 178, 180 is substantially flat creating the square-shape of fourth square-shaped tube 24 and cooperates with the other side walls 176, 178, 180, 174 to define a fourth tube passage 175 therebetween having a square cross-section.

In preferred embodiments of the present invention, first vertical side wall 152 of third square-shaped tube 22 is coupled to first vertical side wall 178 of fourth square-shaped tube 24 by MIG tack-welding third square-shaped tube 22 to fourth square-shaped tube 24 at locations 214 on both the top and bottom side walls 148, 150, 174, 176 of third and fourth square-shaped tubes 22, 24 as shown, for example, in FIG. 2. In alternative embodiments, the tubes remain in side-by-side relationship so that the tubes remain adjacent to one another, but a gap exists between each of the respective tubes.

First vertical side wall 178 of fourth square-shaped tube 24 includes an edge 179 positioned between closed end 166 and an opened outlet end 168 and defining an exhaust gas-admitting aperture 182 as shown in FIG. 3. Fourth square-shaped tube 24 further includes a circular-shaped flange or conduit 183 positioned between closed end 166 and an opened outlet end 168 that includes an edge 181 that defines exhaust gas-admitting aperture 182. Circular-shaped flange 183 extends into exhaust gas-discharging aperture 156 formed in third square-shaped tube 22 to form a third exhaust gas passage 185 so that exhaust gas can travel from third tube passage 149 defined by third square-shaped tube 22 through third exhaust gas passage 185 into fourth tube passage defined by fourth square-shaped tube 24 as shown in FIG. 3.

Fourth square-shaped tube 24 further includes a first section 184 positioned to lie in first subchamber 82 and a second section 186 positioned to lie in second subchamber 84. Second section 186 is formed to include a plurality of perforations 188 so that exhaust gas flowing through fourth square-shaped tube 24 communicates with second subchamber 84. Perforations 188 are formed in top side wall 174, bottom side wall 176, and second vertical side wall 180 in second section 186 of fourth square-shaped tube 24 as shown, for example, in FIGS. 1–3. Therefore, second subchamber 84 is configured to attenuate high frequency sound waves and perforations 118, 142, 164, 188 formed in tubes 18, 20, 22, 24 allow first, second, third, and fourth square-shaped tubes 18, 20, 22, 24 to communicate these high frequency sound waves to second subchamber 84.

In alternative embodiments, louvers (not shown) are used instead of perforations on the square-shaped tubes. When louvers are used, ridges (not shown) are stamped in top and bottom side walls of the square-shaped tubes and the rectangle-shaped tube-receiving aperture of the baffle plate is enlarged to provide clearance for the louvers during insertion of the square-shaped tubes into the rectangle-shaped tube-receiving aperture. The ridges then seal with the inner flange of the baffle plate. Therefore, clearance is provided for insertion of the square-shaped tubes having louvers through the baffle plate and the square-shaped tubes are substantially sealed with the baffle plate. An example of ridges and their interaction with a baffle plate are disclosed in U.S. Patent Application, entitled STAMP-FORMED MUFFLER, attorney-docket number 9501-63525, and filed Apr. 2, 1999 by James R. Allman which is incorporated herein by reference.

Exhaust gas travels through square-shaped tubes 18, 20, 22, 24 of muffler 10 as shown in FIG. 3. Exhaust gas travels in direction 190 through inlet end 86 of first square-shaped tube 18 to enter first tube passage 97 defined by first square-shaped tube 18. The exhaust gas in first square-shaped tube 18 communicates with second subchamber 84 through perforations 118 formed in second section 116 of first square-shaped tube 18. The exhaust gas then flows in direction 192 through first exhaust gas passage 137 into second tube passage 127 defined by second square-shaped tube 20 as shown in FIG. 3. The exhaust gas in second square-shaped tube 20 communicates with first subchamber 82 through square-shaped opened end 120 of second square-shaped tube 20 and communicates with second subchamber 84 through perforations 142 formed in second section 140 of second square-shaped tube 20.

The exhaust gas then flows in direction 194 through second exhaust gas passage 161 into third tube passage 149 defined by third square-shaped tube 22 as shown in FIG. 3. The exhaust gas in third square-shaped tube 22 communicates with second subchamber 84 through perforations 164 formed in second section 162 of third square-shaped tube 22. The exhaust gas continues flowing in direction 196 through third exhaust gas passage 185 into fourth tube passage 175 defined by fourth square-shaped tube 24 as shown in FIG. 3. The exhaust gas in fourth square-shaped tube 24 communicates with second subchamber 84 through perforations 188 formed in second section 186 of fourth square-shaped tube 24. The exhaust gas travels in direction 198 through outlet end 168 of fourth square-shaped tube 24 to exit muffler 10.

Exhaust gas passages 137, 161, 185 are spaced apart from each other so that the exhaust gas must travel along a serpentine path through first, second, third, and fourth tube passage 97, 127, 149, 175 defined by square-shaped tubes 18, 20, 22, 24 as shown in FIG. 3. First exhaust gas passage 137 is formed in first sections 114, 138 of first and second square-shaped tubes 18, 20, respectively, adjacent to baffle plate 16. Second exhaust gas passage 161 is formed in second sections 140, 162 of second and third square-shaped tubes 20, 22, respectively, and third exhaust gas passage 185 is formed in first sections 160, 184 adjacent to closed ends 144, 166 of third and fourth square-shaped tubes 22, 24, respectively.

Figure 6:
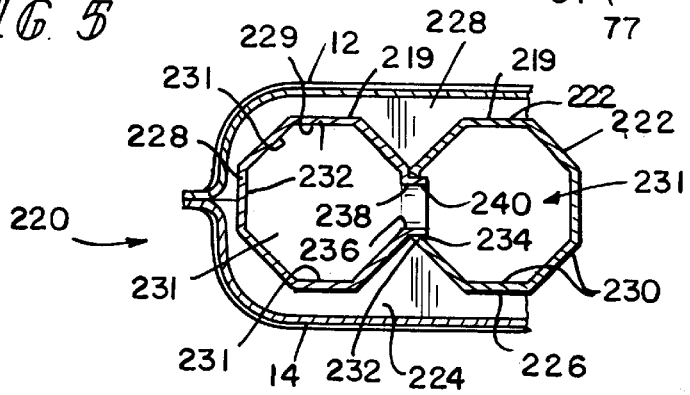
FIG. 6 is a partial sectional view, similar to FIG. 5, of another embodiment of a muffler according to the present invention showing the muffler including octagon-shaped tubes situated between top and bottom outer shells.

A portion of a muffler 220 according to an alternative embodiment of the present invention is shown in FIG. 6. Muffler 220 includes tubes 222, 228 formed to include central body portions 219 having octagon-shaped cross sections (hereinafter "octagon-shaped tubes" 222, 228) instead of square-shaped tubes 18, 20, 22, 24 of muffler 10. Octagon-shaped tubes 222, 228 include flat side walls 230, 232 similar to side walls 94, 96, 98, 110, 124, 126, 128, 130, 148, 150, 152, 154, 174, 176, 178, 180 of square-shaped tubes 18, 20, 22, 24 that cooperate to define a tube passage 231 having an octagonal cross-section. The flat side wall 230 of octagon-shaped tube 222 that faces toward flat side wall 232 of octagon-shaped tube 228 is formed to include a gas exhaust aperture 234. Octagon-shaped tube 228 includes a flange 236 that provides a conduit having an edge 237 defining a gas exhaust aperture 238. Flange 236 extends into gas exhaust aperture 234 to define an exhaust gas passage 240 through which exhaust gas may flow between octagon-shaped tubes 222, 228.

Muffler 220 further includes a baffle plate 224 including a base 225 and an inner flange 227 having an edge 229 with flat portions 231 defining an octagon-shaped tube-receiving aperture 226. Tube-receiving aperture 226 has a shape that matches the periphery of octagon-shaped tubes 222 as shown in FIG. 6. All other components of muffler 220 are identical to muffler 10. In alternative embodiments (not shown) of the present invention, other non-round tubes may be used instead of square-shaped and octagon-shaped tubes. For example, other polygon-shaped tube such as triangle-shaped tubes, rectangle-shaped tubes, heptagon-shaped tubes, hexagon-shaped tubes, pentagon-shaped tubes, etc. may also be used. Furthermore, tubes with curved side walls may also be used.

As discussed above, in preferred embodiments of the present invention, square-shaped tubes 18, 20, 22, 24 are coupled to each other by MIG tack-welding square-shaped tubes 18, 20, 22, 24 at locations 210, 212, 214 on both the top and bottom side walls 94, 96, 124, 126, 148, 150, 174, 176 of square-shaped tubes 18, 20, 22, 24. In alternative embodiments of the present invention, the square-shaped tubes may be coupled together in any manner.

Square-shaped tubes 18, 20, 22, 24, octagon-shaped tubes 222, 228 and other non-round-shaped tubes are easy to couple to each other. The non-round-shaped tubes 18, 20, 22, 24, 222, 228 are easy to couple to each other in side-by-side relationship because they have mating flat side walls that provide a large contact surface between tubes 18, 20, 22, 24, 222, 228. In addition, square-shaped tubes 18, 20, 22, 24, octagon-shaped tubes 222, 228, and other non-round-shaped tubes are easy to manufacture.

Exhaust gas passes easily between non-round-shaped tubes 18, 20, 22, 24, 222, 228 coupled to each other in side-by-side relation via exhaust gas passages 137, 161, 185, 240 formed in the mating flat side walls of non-round-shaped tubes 18, 20, 22, 24, 222, 228. Exhaust gas passages 137, 161, 185, 240 are defined by mating apertures formed in the mating flat side walls of non-round-shaped tubes 18, 20, 22, 24, 222, 228.

The flat side walls of non-round-shaped tubes 18, 20, 22, 24, 222, 228 also provide more surfaces to form louvers or perforations, such as perforations 118, 142, 164, 188 formed in square-shaped tubes 18, 20, 22, 24 as shown in FIGS. 1–3. The more surfaces that are formed to include perforations, the more directions that exhaust gas can be directed out of the non-round-shaped tubes 18, 20, 22, 24, 222, 228 and into subchambers 82, 84.

Although the invention has been disclosed in detail with reference to certain preferred embodiments, variations and modifications exist within the scope and spirit of the invention.

What is claimed is:

1. A muffler comprising an outer shell defining a chamber, a first tube positioned in the chamber and having a flat side wall formed to include an aperture, and a second tube positioned in the chamber and having a flat side wall positioned to lie adjacent to the flat side wall of the first tube and the second tube is formed to include a first conduit extending from the flat side wall into the aperture formed in the flat side wall of the first tube to communicate exhaust gas between the first and second tubes through the first conduit.

2. The muffler of claim 1, wherein the first tube includes four flat side walls cooperating to define a passage therebetween.

3. The muffler of claim 2, wherein passage has a rectangular cross-section.

4. The muffler of claim 3, wherein the passage has a square cross-section.

5. The muffler of claim 1, wherein the first tube has a first end and a second end spaced apart from the first end, the flat side wall of the first tube includes an edge defining a first aperture, the flat side wall of the second tube includes an edge defining a second aperture, and the first and second apertures are aligned with each other.

6. The muffler of claim 5, wherein the first tube contacts the second tube.

7. The muffler of claim 1, wherein the flat side wall of the first tube contacts the flat side wall of the second tube.

8. The muffler of claim 7, wherein the flat side wall of the first tube is coupled to the flat side wall of the second tube.

9. The muffler of claim 1, wherein the second tube includes a second flat side wall formed to include an aperture and further comprising a third tube positioned in the chamber and having a first flat side wall positioned to lie adjacent the second flat side wall of the second tube and formed to include a second conduit extending into the aperture formed in the second flat side wall of the second tube to communicate exhaust gas between the first and second tubes through the second conduit.

10. The muffler of claim 9, further comprising a baffle plate positioned in the chamber to partition the chamber into first and second chamber sections, and wherein the first conduit is positioned to lie in the first chamber section and the second conduit is positioned to lie in the second chamber section.

11. The muffler of claim 10, wherein the second tube has a closed end positioned to lie in the second chamber section and an opened end positioned to lie in the first chamber section.

12. The muffler of claim 10, wherein the second tube has a closed end positioned to lie in the second chamber section and is formed to include perforations arranged to lie in the second chamber section to communicate exhaust gas from the second tube into the second chamber section.

13. The muffler of claim 9, wherein the third tube includes a second flat side wall formed to include an aperture and further comprising a fourth tube positioned in the chamber and having a first flat side wall positioned to lie adjacent to the second flat side wall of the third tube and formed to include a third conduit extending into the aperture formed in the second flat side wall of the third tube to communicate exhaust gas between the third and fourth tubes through the third conduit.

14. The muffler of claim 13, further comprising a baffle plate positioned in the chamber to partition the chamber into first and second chamber sections, and wherein the first and third conduits are positioned to lie in the first chamber section and the second conduit is positioned to lie in the second chamber section.

15. The muffler of claim 14, wherein each tube is formed to include perforations to communicate exhaust gas from said each tube into the second chamber section.

16. A muffler comprising an outer shell defining a chamber, a first tube positioned in the chamber and having a flat side wall, and a second tube positioned in the chamber and having a flat side wall positioned adjacent to the flat side wall of the first tube, and a baffle plate including a base and an edge defining a tube-receiving aperture and the first and second tubes are positioned in the tube-receiving aperture.

17. The muffler of claim 16, wherein the first and second tubes include a plurality of flat side walls and the edge of the of the baffle plate includes a flat portion configured to engage at least one of the flat side walls of the first and second tubes.

18. The muffler of claim 16, wherein the baffle plate is positioned in the chamber to partition the chamber into first and second chamber sections and the first tube includes a closed end positioned to lie in the second chamber section and an open end coupled to an opening formed in the outer shell.

19. The muffler of claim 18, wherein the second tube includes a closed end positioned to lie in the second chamber section and an opened end positioned to lie in the first chamber section.

20. The muffler of claim 19, wherein the flat side wall of the first tube is formed to include an aperture and the second tube is formed to include a first conduit lying in the first chamber section and extending from the flat side wall of the second tube into the aperture to communicate exhaust gas between the first and second tubes through the first conduit.

21. The muffler of claim 19, wherein a third tube is positioned in the tube-receiving aperture to position the second tube between the first and third tubes, the third tube includes a closed end positioned to lie in the second chamber section and a closed end positioned to lie in the first chamber section, and a second conduit is positioned to communicate exhaust gas between the second and third tubes through the second conduit.

22. The muffler of claim 21, wherein a fourth tube is positioned in the tube-receiving aperture to position the third tube between the second and fourth tubes, the fourth tube includes a closed end positioned to lie in the first chamber section and an opened end coupled to another opening formed in the outer shell, and a third conduit is positioned to communicate exhaust gas between the third and fourth tubes through the third conduit.

23. A muffler comprising an outer shell defining a chamber, a first tube positioned in the chamber and having a flat side wall, and a second tube positioned in the chamber and having a flat side wall positioned adjacent to the flat side wall of the first tube, wherein the first tube has a closed end and an opened end spaced apart from the closed end.

24. A muffler comprising an outer shell defining a chamber, a first tube positioned in the chamber and having a flat side wall, and a second tube positioned in the chamber and having a flat side wall positioned adjacent to the flat side wall of the first tube, wherein the first tube has a first closed end and a second closed end spaced apart from the first closed end.

25. A muffler comprising an outer shell defining a chamber, a first tube positioned in the chamber and having a flat side wall, and a second tube positioned in the chamber and having a flat side wall positioned adjacent to the flat side wall of the first tube, wherein the first tube includes a body portion including the flat side wall, a round inlet portion, and a transition portion coupled to the body portion and the round inlet portion.

26. A muffler comprising an outer shell defining a chamber, a first tube positioned in the chamber, the first tube including an opened first end, a closed second end spaced apart from the opened first end, and a wall defining a first passage and including an edge positioned between the first and second ends, the edge defining a first aperture, and a second tube positioned in the chamber, the second tube including an opened first end, a closed second end spaced apart from the opened first end, and a wall defining a second passage and including an edge positioned between the first and second ends, the edge defining a second aperture, the wall of the first tube contacting the wall of the second tube so that the first aperture of the first tube communicates with the second aperture of the second tube.

27. The muffler of claim 26, wherein the wall of the first tube is flat and the wall of the second tube is flat.

28. The muffler of claim 27, wherein the second tube includes a conduit coupled to the wall defining a passage and the conduit extends into the first aperture defined by the edge of the first tube so that the passage defined by the conduit permits communication between the first passage of the first tube and the second passage of the second tube.

29. The muffler of claim 26, further comprising a baffle plate positioned in the chamber defined by the outer shell, wherein the baffle includes a base and an edge defining a tube-receiving aperture and the first and second tubes are positioned in the tube-receiving aperture.

30. The muffler of claim 26, further comprising a third tube, wherein the second tube includes first and second walls, the first wall of the second tube including the edge defining the second aperture of the second tube, the second wall of the second tube including an edge positioned between the first and second ends and defining a third aperture, the third tube includes a first end, a second end, and a wall including an edge positioned between the first and second ends and defining a fourth aperture, the wall of the third tube contacts the second wall of the second tube so that the fourth aperture of the third tube communicates with the third aperture of the second tube.

31. The muffler of claim 30, further comprising a fourth tube, wherein the third tube includes first and second walls, the first wall of the third tube including the edge that defines the fourth aperture of the second wall, the second wall of the third tube including an edge positioned between the first and second ends and defining a fifth aperture, the third tube includes a first end, a second end, and a wall including an edge positioned between the first and second ends and defining a sixth aperture, the wall of the third tube contacting the second wall of the third tube so that the sixth aperture of the fourth tube communicates with the fifth aperture of the second tube.

32. A muffler comprising an outer shell defining a chamber, a first tube positioned in the chamber, the first tube including a first end, a second end spaced apart from the first end, and a wall defining a first passage and including an edge positioned between the first and second ends, the edge defining a first aperture, a second tube positioned in the chamber, the second tube including a first end, a second end spaced apart from the first end, a wall, and a conduit coupled to the wall and defining a passage therein, the wall of the second tube defining a second passage and including an edge positioned between the first and second ends, the edge defining a second aperture, and a conduit extending from the edge of the second tube into the first aperture of the first tube so that the passage defined by the conduit permits communication between the first passage of the first tube and the second passage of the second tube.

33. The muffler of claim 32, wherein the wall of the first tube is flat and the wall of the second tube is flat.

34. The muffler of claim 32, further comprising a baffle plate positioned in the chamber defined by the outer shell, wherein the baffle includes a base and an edge defining a tube-receiving aperture and the first and second tubes are positioned in the tube-receiving aperture.

35. A muffler comprising an outer shell defining a chamber, a first tube positioned in the chamber, the first tube including a first end, a second end spaced apart from the first end, and a wall defining a first passage and including an edge positioned between the first and second ends, the edge defining a first aperture, a second tube positioned in the chamber, the second tube including a first end, a second end spaced apart from the first end, a wall and a conduit coupled to the wall and defining a passage therein, the wall of the second tube defining a second passage and including an edge positioned between the first and second ends, the edge defining a second aperture, the conduit extends from the edge of the second tube to the first aperture of the first tube so that the passage defined by the conduit permits communication between the first passage of the first tube and the second passage of the second tube, and a third tube, wherein the second tube includes first and second walls, the first wall of the second tube including the edge defining the second aperture of the second tube, the second wall of the second tube including an edge positioned between the first and second ends and defining a third aperture, the third tube includes a first end, a second end, a wall, and a conduit coupled to the wall of the third tube and defining a passage therein, the wall of the third tube defining a third passage and including an edge positioned between the first and second ends, the edge of the third tube defining a fourth aperture, the conduit of the third tube extends from the edge of the third tube to the third aperture of the second tube so that the passage defined by the conduit of the third tube permits communication between the second passage of the second tube and the third passage of the third tube.

36. The muffler of claim 35, further comprising a fourth tube, wherein the third tube includes first and second walls, the first wall of the third tube including the edge defining the fourth aperture of the third tube, the second wall of the third tube including an edge positioned between the first and second ends and defining a fifth aperture, the fourth tube includes a first end, a second end, a wall, and a conduit coupled to the wall of the fourth tube and defining a passage therein, the wall of the fourth tube defining a fourth passage and including an edge positioned between the first and second ends, the edge of the fourth tube defining a sixth aperture, the conduit of the fourth tube extends from the edge of the fourth tube to the fifth aperture of the third tube so that the passage defined by the conduit of the fourth tube permits communication between the third passage of the third tube and the fourth passage of the fourth tube.

37. A muffler comprising an outer shell defining a chamber, a baffle plate positioned in the chamber defined by the outer shell, the baffle including base and an edge defining a tube-receiving aperture, a first tube positioned in the chamber defined by the outer shell, and a second tube positioned in the chamber, the first and second tubes having at least one flat side wall and being positioned in the tube-receiving aperture of the baffle.

38. The muffler of claim 37, wherein the edge of the of the baffle plate includes a flat portion configured to contact the flat side walls of the first and second tubes.

39. The muffler of claim 37, wherein the outer shell includes a groove and the baffle plate includes an outer edge positioned in the groove of the outer shell.

40. The muffler of claim 37, wherein the tube-receiving aperture is rectangle-shaped to receive the first and second side tubes and engage the flat side walls thereof.

41. The muffler of claim 37, wherein the edge defining the tube-receiving aperture is continuous.

42. The muffler of claim 37, wherein the outer shell includes a first half and a second half coupled to the first half and the baffle plate includes a first portion positioned between the first half of the outer shell and the first and second tubes and second portion positioned between the second half of the outer shell and the first and second tubes, the first and second portions cooperate to define the tube-receiving aperture, and the first portion is integral with the second portion.

43. The muffler of claim 37, wherein the tubes are polygon-shaped.

44. The muffler of claim 43, wherein the tubes are square-shaped.

45. The muffler of claim 43, wherein the tubes are octagon-shaped.

* * * * *